US006481828B2

(12) United States Patent
Baek et al.

(10) Patent No.: US 6,481,828 B2
(45) Date of Patent: Nov. 19, 2002

(54) INK-JET PRINTHEAD HAVING HIGH NOZZLE DENSITY

(75) Inventors: Seog Soon Baek, Suwon; Hyeon-cheol Kim, Seoul; Yong-soo Oh, Seongnam, all of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/005,071

(22) Filed: Dec. 7, 2001

(65) Prior Publication Data

US 2002/0075358 A1 Jun. 20, 2002

(30) Foreign Application Priority Data

Dec. 16, 2000 (KR) ..... 2000-77405

(51) Int. Cl.[7] ..... B41J 2/14; B41J 2/16; B41J 2/05

(52) U.S. Cl. ..... 347/48; 347/63

(58) Field of Search ..... 347/63, 65, 48, 347/62, 20, 54

(56) References Cited

U.S. PATENT DOCUMENTS

| | | | | |
|---|---|---|---|---|
| 4,296,421 A | | 10/1981 | Hara et al. | 347/48 |
| 4,894,664 A | * | 1/1990 | Tsung Pan | 347/65 |
| 5,635,966 A | | 6/1997 | Keefe et al. | 347/43 |

* cited by examiner

*Primary Examiner*—Judy Nguyen
*Assistant Examiner*—Juanita Stephens
(74) *Attorney, Agent, or Firm*—Lee & Sterba, P.C.

(57) ABSTRACT

An inkjet printhead includes a nozzle plate having a nozzle, a substrate having an ink feed hole, and an intermediate layer interposed between the nozzle plate and the substrate, wherein the intermediate layer includes an ink chamber connected to the ink feed hole and the nozzle and a heating element surrounding the ink chamber. In the present invention, the nozzle, the ink chamber, and the ink feed hole are formed in a straight channel, thereby providing a high density printhead.

36 Claims, 6 Drawing Sheets

INK-JET PRINTHEAD HAVING HIGH NOZZLE DENSITY

BACKGROUND OF THE INVENTION

1. Field of the Invention

The present invention relates to an ink-jet printhead. More particularly, the present invention relates to an ink-jet printhead having a high nozzle density.

2. Description of the Related Art

Inkjet printing heads are devices for printing in a predetermined color image by ejecting a small droplet of printing ink at a desired position on a recording sheet. Ink ejection mechanisms of an ink-jet printer are generally categorized into two types: an electro-thermal transducer type (bubble-jet type), in which a heat source is employed to form a bubble in ink causing an ink droplet to be ejected, and an electromechanical transducer type, in which a piezoelectric crystal bends to change the volume of ink causing an ink droplet to be expelled.

Referring to FIGS. 1A and 1B, a conventional bubble-jet type ink ejection mechanism will now be described. When a current pulse is applied to a heater 12 consisting of resistive heating elements formed in an ink channel 10 where a nozzle 11 is located, heat generated by the heater 12 boils ink 14 to form a bubble 15 within the ink channel 10, which causes an ink droplet 14' to be ejected.

There are multiple factors and parameters to consider in making an ink-jet printhead having a bubble-jet type ink ejector. First, it should be simple to manufacture, have a low manufacturing cost, and be capable of being mass-produced. Second, in order to produce high quality color images, the formation of minute, undesirable satellite ink droplets that usually trail an ejected main ink droplet must be avoided. Third, when ink is ejected from one nozzle or when ink refills an ink chamber after ink ejection, cross-talk with adjacent nozzles from which no ink is ejected must also be avoided. To this end, a back flow of ink in a direction opposite to the direction ink is ejected from a nozzle must be prevented during ink ejection. For this purpose, a second heater 13 as shown in FIGS. 1A and 1B is typically provided to prevent a back flow of the ink 14. The second heater 13 generates heat earlier than the first heater 12, which causes a bubble 16 to shut off the ink channel 10 behind the first heater 12. Then, the first heater 12 generates heat, and the bubble 15 expands to cause the ink droplet 14' to be ejected. Fourth, for high-speed printing, a cycle beginning with ink ejection and ending with ink refill in the ink channel must be carried out in as short a period of time as possible. Fifth, a nozzle and an ink channel for introducing ink to the nozzle must not be clogged by a foreign material or by solidified ink.

The above requirements, however, tend to conflict with one another. Furthermore, the performance of an ink-jet printhead is closely associated with and affected by the structure and design of an ink chamber, an ink channel, and a heater, as well as by the type of formation and expansion of bubbles, and the relative size of each component.

In order to offer higher resolutions and to lower the price of an ink-jet printhead, an area per unit nozzle must be minimized and a nozzle density must be maximized.

In terms of the ink ejection mechanism utilized, conventional bubble-jet type ink-jet printheads are categorized into two types. A first type of printhead shown in FIG. 2 (disclosed in U. S. Pat. No. 5,635,966) is designed to eject an ink droplet in a direction in which a bubble 23 is formed. In this structure, an ink chamber 22 for containing a predetermined amount of ink 25 has an area larger than a nozzle 21. Furthermore, ink feed grooves for supplying the ink 25 to the ink chamber 22 are separated from the nozzle 21, thereby increasing an area per unit nozzle. Thus, the first type of printhead has a limit in increasing nozzle density in the printhead.

A second type of printhead shown in FIG. 3 (disclosed in U. S. Pat. No. 4,296,421) is designed to eject an ink droplet 35 horizontally, that is, in a direction perpendicular to that in which a bubble 33 is formed. Each component in this structure is difficult to arrange vertically due to restriction in the process. Since a nozzle 31 is arranged horizontally, the second type of printhead also involves a limit in increasing nozzle density in the printhead.

SUMMARY OF THE INVENTION

In an effort to solve the above problems, it is a feature of an embodiment of the present invention to provide an ink-jet printhead in which a nozzle, an ink chamber, and an ink feed hole are formed in one channel thereby minimizing an area per unit nozzle and increasing a nozzle density.

Accordingly, the present invention provides an ink-jet printhead including: a nozzle plate having a nozzle for ejecting ink; a substrate having an ink feed hole for supplying ink from an ink reservoir, the substrate being separated from the nozzle plate by a predetermined distance; and an intermediate layer interposed between the substrate and the nozzle plate, the intermediate layer including an ink chamber connected to the ink feed hole and the nozzle and a heating element surrounding the ink chamber. Preferably, the nozzle, the ink chamber, the ink feed hole are formed in a straight channel.

The heating element includes a first heater for generating heat by the application of current, a second heater for receiving the heat generated by the first heater and boiling ink within the ink chamber to generate a bubble, and a heat transfer layer in contact with the first and second heaters for transferring the heat generated by the first heater to the second heater. Preferably, the second heater is formed of diamond, gold, copper, or silicon. Also preferably, the heat transfer layer is formed of either of diamond or SiC.

Preferably, the first heater, the heat transfer layer, and the second heater, excluding a portion in contact with the ink filling the ink chamber, are surrounded by an adiabatic layer. Also preferably, the adiabatic layer is formed of a silicon oxide layer.

Preferably, the heating element includes a first heater for generating heat by the application of current and a second heater for receiving the heat generated by the first heater and boiling ink within the ink chamber to generate a bubble. Also preferably, the second heater is formed of either diamond or SiC. Preferably, the first and second heaters, excluding a portion in contact with the ink filling the ink chamber, are surrounded by an adiabatic layer.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Korean Patent Application No. 2000-77405, filed Dec. 16, 2000, and entitled: "Ink-jet Printhead," is incorporated by reference herein in its entirety.

Figure 1A:
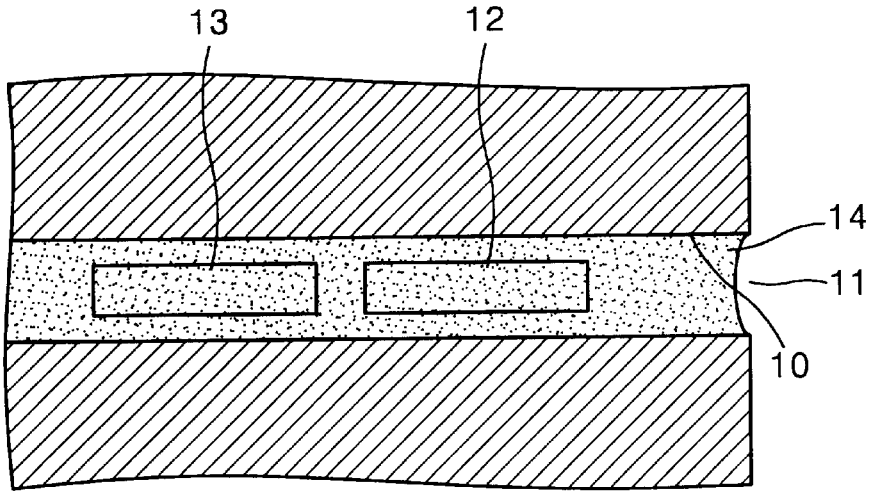
FIG. 1A (PRIOR ART)
FIGS. 1A and 1B illustrate cross-sectional views of a conventional bubble-jet type ink-jet printhead.
Figure 1B:
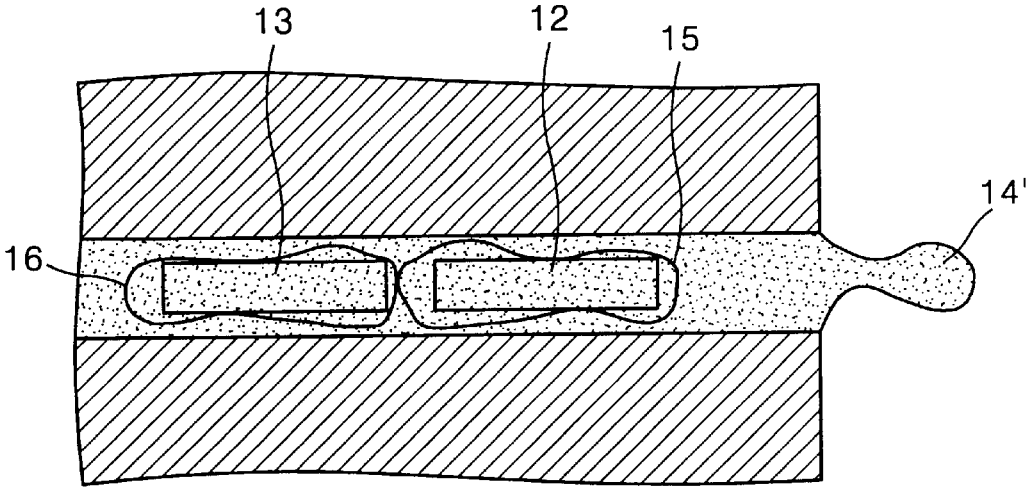
FIG. 1B (PRIOR ART)
Figure 2:
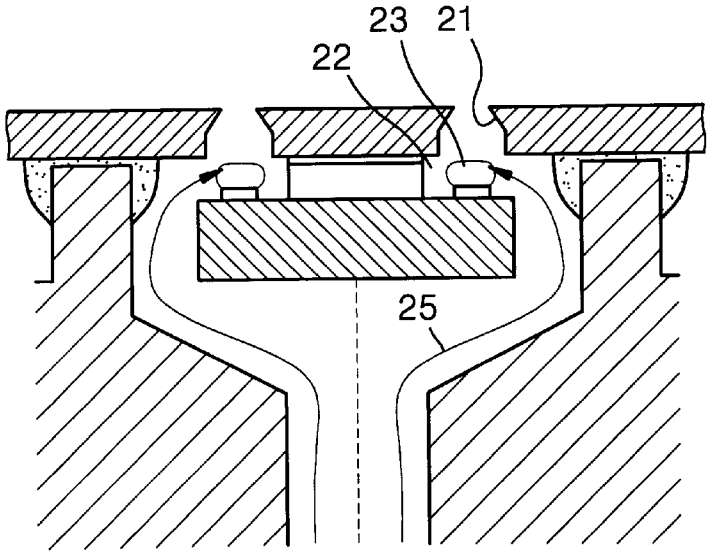
FIG. 2 (PRIOR ART)
FIGS. 2 and 3 illustrate schematic cross-sectional views of conventional ink-jet printheads.
Figure 3:
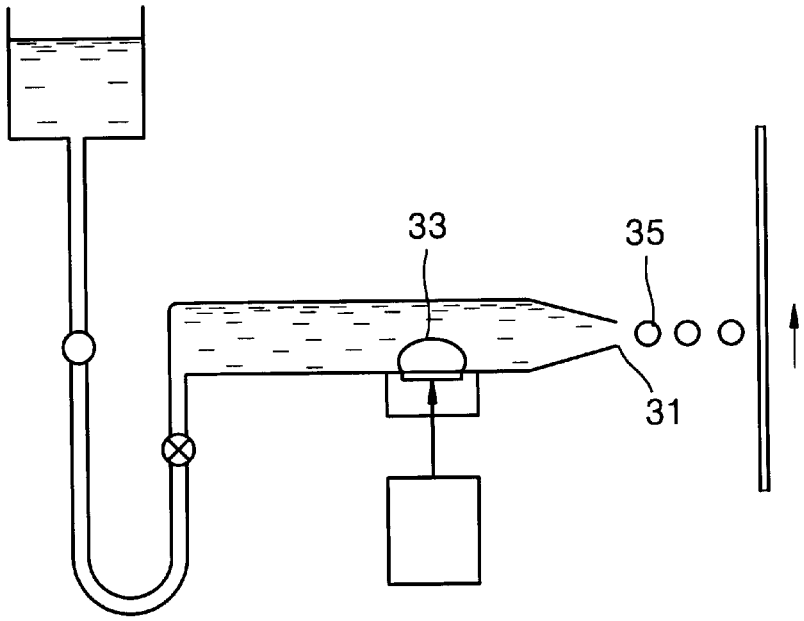
FIG. 3 (PRIOR ART)
Figure 4:
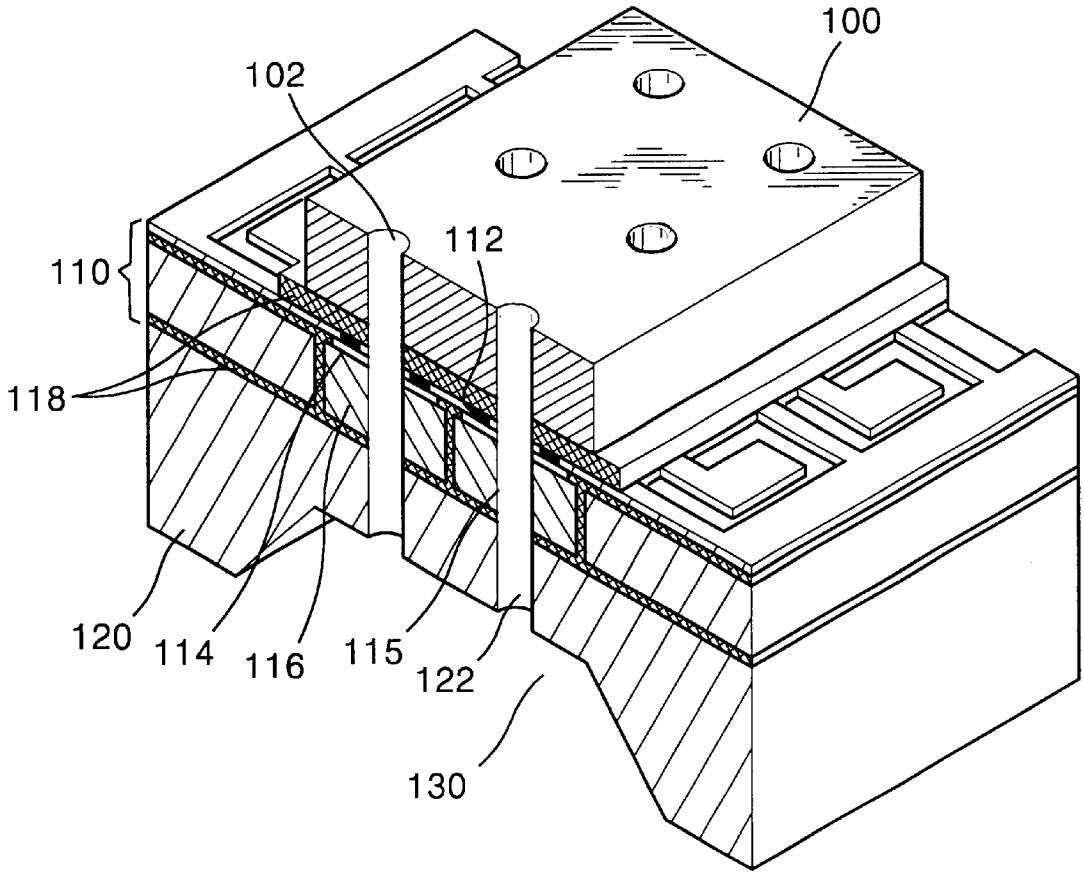
FIG. 4 illustrates a cross-sectional view of an ink-jet printhead according (to a first embodiment of the present invention.

Referring to FIG. 4, an ink-jet printhead according to a first embodiment of the present invention includes a nozzle plate 100, a substrate 120, and an intermediate layer 110. The nozzle plate 100 has a nozzle 102 for ejecting ink droplets, and is separated from a substrate 120 by a predetermined space. The substrate 120 has an ink feed hole 122 for supplying ink to an ink chamber 115 from an ink reservoir 130. The intermediate layer 110 is interposed between the substrate 120 and the nozzle plate 100. Also, the intermediate layer 110 includes the ink chamber 115, connected to the ink feed hole 122 and the nozzle 102, and a heating element surrounding the ink chamber 115.

In the ink-jet printhead according to an embodiment of the present invention, the ink chamber 115 and the ink feed hole 122 are located under the nozzle 102 to minimize the area per unit nozzle. Thus, as shown in FIG. 4, the nozzle 102, the ink chamber 115, and the ink feed hole 122 are formed in a straight channel.

The ink-jet printhead having the structure as described above should have a heater sufficiently thick to generate bubbles greater than a predetermined amount. This is because a larger amount of bubbles allows the ink to be ejected against friction. However, it is difficult to make a heater, which is electrically insulated from the outside, having a large thickness and high cross-section ratio. Thus, the present invention adopts a method whereby heat of a heater is not transferred directly to the ink but rather the heat is transferred through a substance having high thermal conductivity. More particularly, the heating element surrounding the ink chamber 115 includes a first heater 112 for generating heat by the application of current a heat transfer layer 114, which is in contact with the first heater 112, for propagating the heat generated by the first heater 112 to a second heater 116, and a second heater 116 for receiving the heat from the heat transfer layer 114 and for heating the ink within the ink chamber 115 to form a bubble.

As shown in FIG. 4, the ink-jet printhead according to this embodiment of the present invention is configured so that the first heater 112 is disposed on and above the intermediate layer 110 and the heat transfer layer 114 is disposed between the first heater 112 and the second heater 116. Furthermore, it is preferred that the first heater 112, the heat transfer layer 114 and the second heater 116, excluding a portion in contact with ink, are surrounded by an adiabatic layer 118.

In the structure described above, the application of current to an external electrode (not shown) causes the first heater 112 to generate heat. The heat is then transferred to the second heater 116 through the heat transfer layer 114 thereby boiling the ink. Here, an intermediate heat transfer material, such as diamond or SiC, which is electrically insulated and heat conductive, is preferably used as the heat transfer layer 114. A material having good thermal conductivity and small heat capacity such as silicon, gold, diamond, or copper is preferably used as the second heater 116. Since the first heater 112, the heat transfer layer 114, and the second heater 116 may be surrounded by the adiabatic layer 118, such as a silicon oxide layer, the heat generated by the first heater 112 is concentrically supplied to the second heater 116. Thus, if the heat supplied in this way is applied to the second heater 116, a bubble is formed at a portion where the second heater 116 is in contact with the ink in the ink chamber 115 causing an ink droplet to be ejected. A silicon substrate is preferably used as the substrate 120, and in order to provide a more focused ejection of ink, the nozzle is preferably formed of photoresist PR or polyimide.

Figure 5:
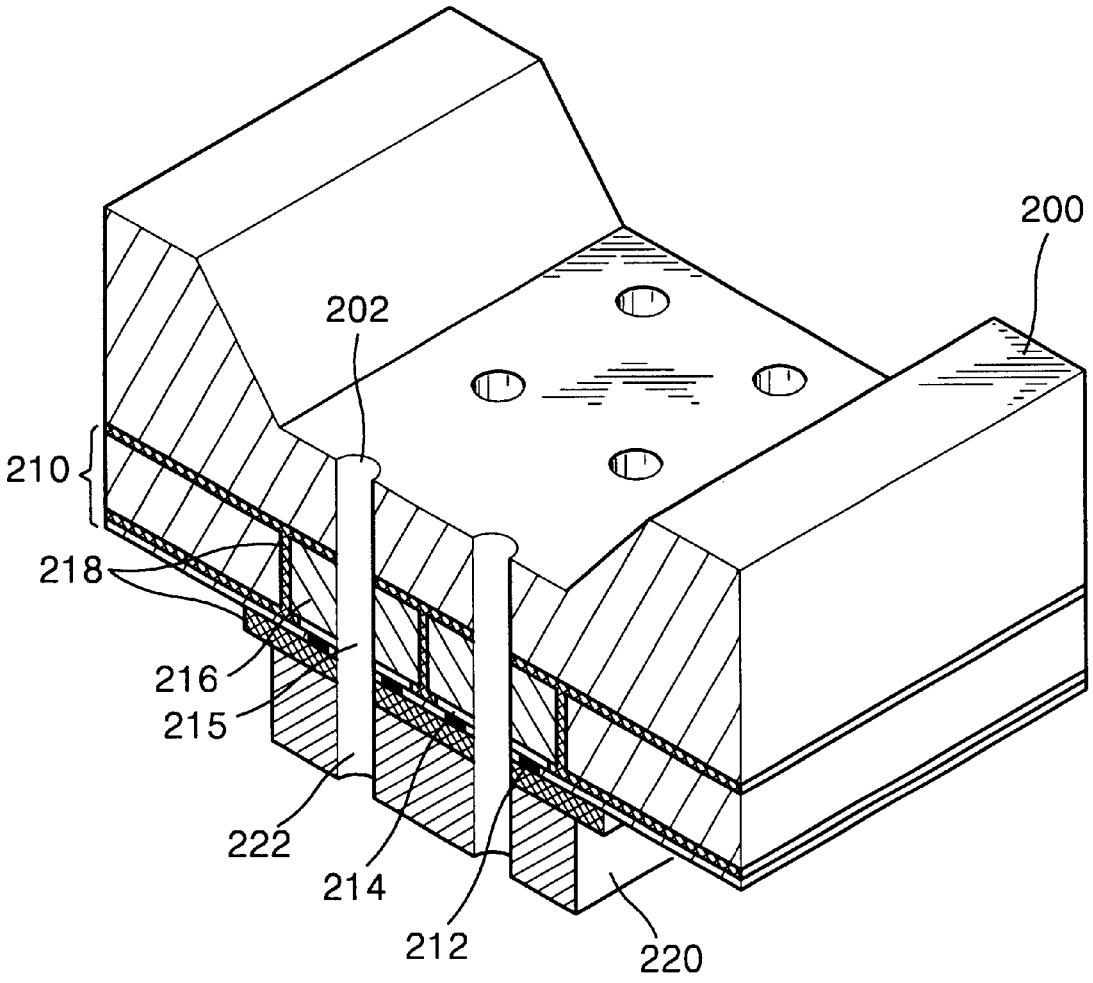
FIG. 5 illustrates a cross-sectional view of an ink-jet printhead according to a second embodiment of the present invention.

FIG. 5 illustrates a cross-sectional view of an ink-jet printhead according to a second embodiment of the present invention. The second embodiment is similar to the first embodiment in that a nozzle, and an ink chamber, an ink feed hole are formed in a straight channel. The difference resides in the arrangement of a heater element.

Referring to FIG. 5, the heating element is arranged so that a first heater 212 is placed on and below of an intermediate layer 210, and a heat transfer layer 214 is disposed between the first heater 212 and a second heater 216. Furthermore, the first heater 212, the heat transfer layer 214, and the second heater 216, excluding a portion in contact with ink, are preferably surrounded by an adiabatic layer 218. A nozzle plate 200 having a nozzle 202 is preferably formed of silicon and a substrate 220 having an ink feed hole 222 is preferably formed of photoresist PR or polyimide so that a bubble formed in an ink chamber 215 effectively grows upward from the bottom.

The principle of operation of the ink-jet printhead having the structure described above is similar to that described in connection with FIG. 4. The same preferred materials for use in the second heater 216, the heat transfer layer 214, and the adiabatic layer 218 as those described in connection with FIG. 4 are used.

Figure 6:
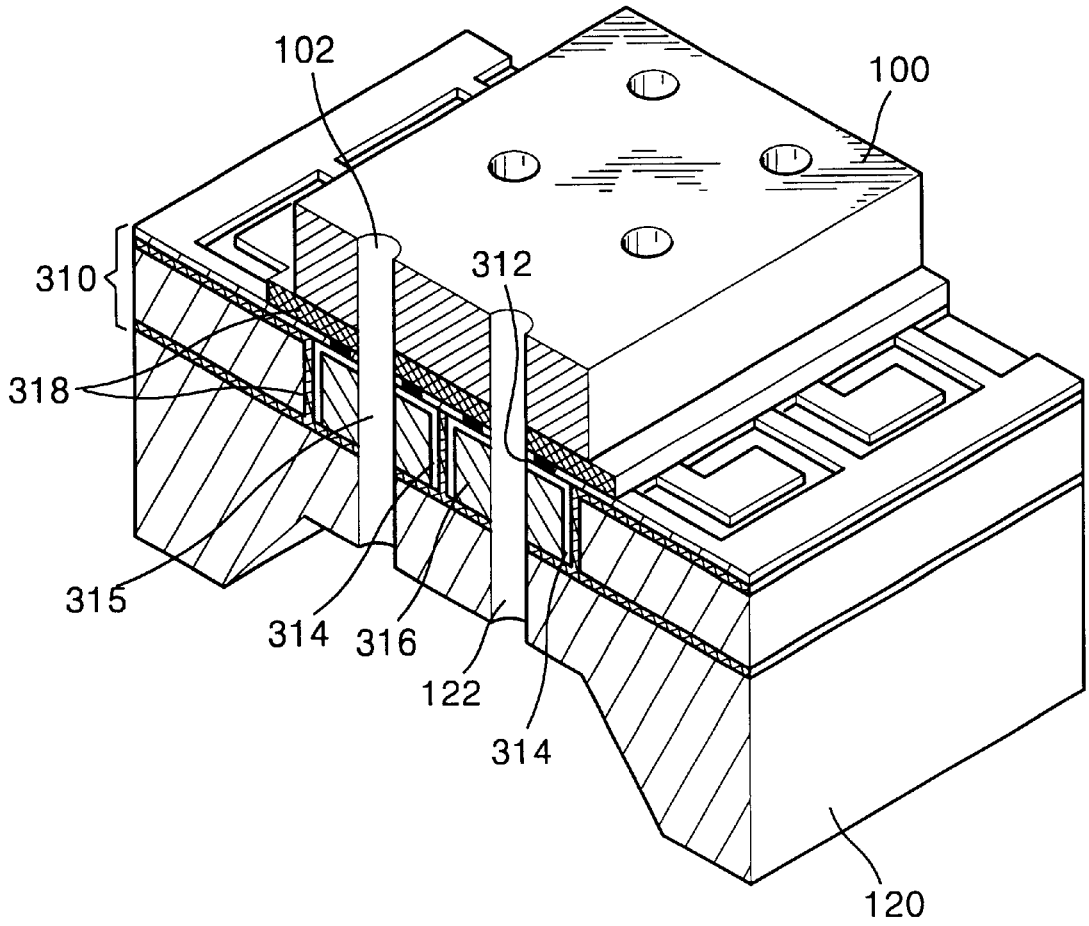
FIG. 6 illustrates a cross-sectional view of an ink-jet printhead according to a third embodiment of the present invention.

FIG. 6 illustrates a cross-sectional view of an ink-jet printhead according to a third embodiment of the present invention. The ink-jet printhead according to this third embodiment is configured so that a heat transfer layer formed on and above a second heater extends to the sides of a second heater. Like reference numerals from FIG. 4 represent like elements in FIG. 6. Referring to FIG. 6, in an intermediate layer 310 including a heating element surrounding an ink chamber 315, a heat transfer layer 314 is formed on the sides of a second heater 316 as well as on and above the second heater 316, and a first heater 312 is formed on and above the heat transfer layer 314. The first heater 312, the heat transfer layer 314, and the second heater 316 are preferably surrounded by an adiabatic layer 318. More particularly, if the interior of second heater 316 having a cylindrical shape forms the wall of the ink chamber 315, the heat transfer layer 314 is formed on the outer sides of the second heater 316 as well as on and above the second heater 316. The principle of operation of the printhead according to this third embodiment and the preferred materials for use in the heat transfer layer 314, the second heater 316, and the adiabatic layer 318 are the same as those described in connection with FIG. 4. In the ink-jet printhead having the structure as described above, heat generated by the first heater 312 is effectively transferred to the second heater 316 through the heat transfer layer 314, thereby increasing heat transfer efficiency. Alternatively, the ink-jet printhead may be configured so that the first heater 312 may be placed on and below the intermediate layer 310 and the heat transfer layer 314 may be formed on and under the sides of the second heater 316.

Figure 7:
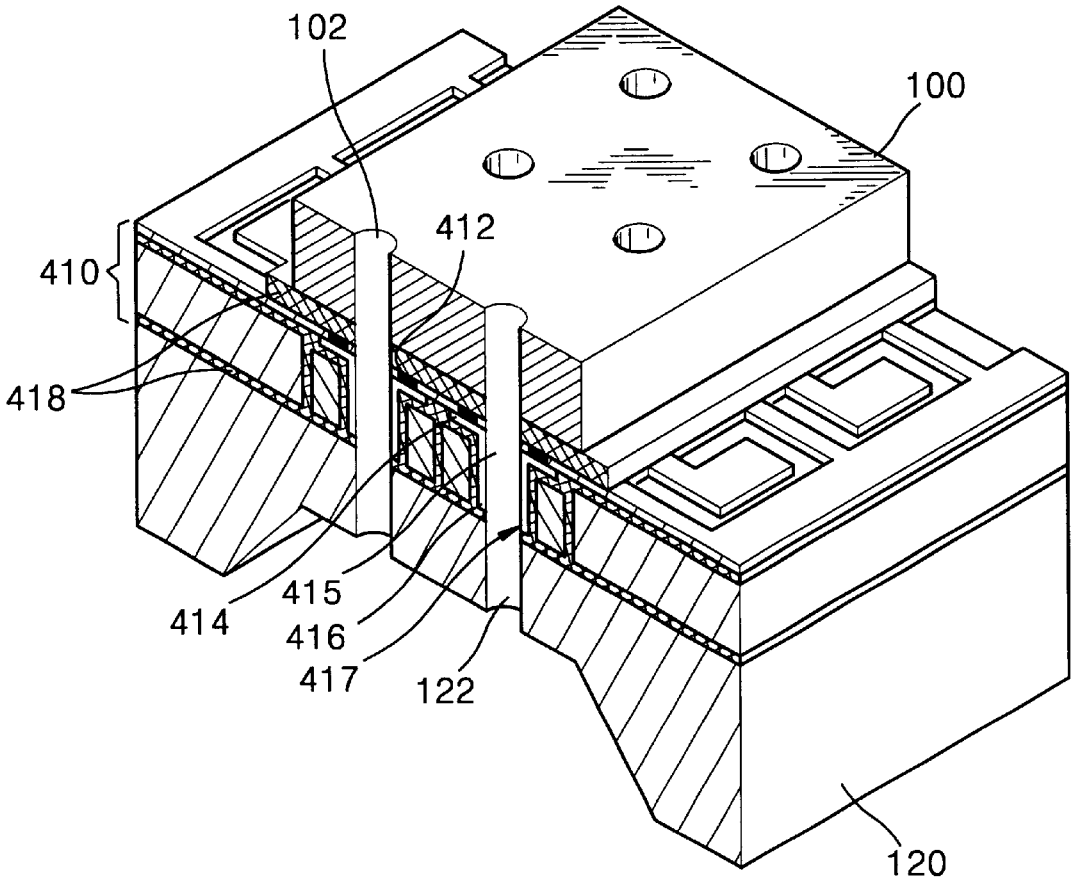
FIG. 7 illustrates a cross-sectional view of an ink-jet printhead according to a fourth embodiment of the present invention.

FIG. 7 illustrates a cross-sectional view of an ink-jet printhead according to a fourth embodiment of the present invention. Like reference numerals from FIG. 4 represent like elements in FIG. 7.

In the fourth embodiment, to form a nozzle, an ink chamber, and an ink feed hole in a straight channel, a heat transfer layer serves as a second heater, unlike in the first through third embodiments, wherein the heat transfer layer 114, 214, or 314 delivers heat generated by the first heater 112, 212, or 312 to the second heater 116, 216,or 316.

Referring to FIG. 7, a heating element surrounding an ink chamber 415 includes a first heater 412 for generating heat by the application of current and a second heater 417 in contact with the first heater 412 for receiving the heat from the first heater 412 and boiling ink, which fills the ink chamber 415 to generate a bubble. More specifically, the first heater 412 is placed on and above the intermediate layer 410 forming the ink chamber 415 while the second heater 417 is placed on and below the intermediate layer 410. The second heater 417, which is in contact with the first heater 412, consists of a flange portion 414 for receiving heat generated by the first heater 412 and a cylindrical body portion 416 for boiling ink within the ink chamber 415 and for generating a bubble. The first and second heaters 412 and 417, excluding a portion in contact with the ink, are preferably surrounded by an adiabatic layer 418. Here, like the heat transfer layer 114, 214, or 314 in the embodiments previously mentioned, the second heater 417 is preferably formed of either diamond or SiC.

In the structure as described above, if the first heater 412 generates heat through the application of current, the heat is transferred first to the flange portion 414 of the second heater 417 in contact with the first heater 412 and then to the body portion 416 thereof in contact with the ink, which fills the ink chamber 415, thereby forming a bubble.

As described above, an ink-jet printhead according to the present invention is configured to have a nozzle, an ink chamber, and an ink feed hole formed in a straight channel, thereby providing an inkjet printhead having high nozzle density and increasing the resolution of the printhead.

While this invention has been particularly shown and described with reference to preferred embodiments thereof, it will be understood by those of ordinary skill in the art that various changes in form and details may be made herein without departing from the spirit and scope of the invention as defined by the appended claims.

What is claimed is:

1. An ink-jet printhead comprising:

a nozzle plate having a nozzle for ejecting ink;

a substrate having an ink feed hole for supplying ink from an ink reservoir, the substrate being separated from the nozzle plate by a predetermined distance; and an intermediate layer interposed between the substrate and the nozzle plate, the intermediate layer including an ink chamber connected to the ink feed hole and the nozzle and a heating element surrounding the ink chamber, wherein the heating element includes a first heater for generating heat by the application of current, a second heater for receiving the heat generated by the first heater and boiling ink, which is in the ink chamber, to generate a bubble, and a heat transfer layer in contact with the first and second heaters for transferring the heat generated by the first heater to the second heater.

2. An ink-jet printhead as claimed in claim 1, wherein the nozzle, the ink chamber, and the ink feed hole are formed in a straight channel.

3. An ink-jet printhead as claimed in claim 2, wherein the second heater is formed of a material selected from the group consisting of diamond, gold, copper, and silicon.

4. An ink-jet printhead as claimed in claim 3, wherein the heat transfer layer is formed of a material selected from the group consisting of diamond and SiC.

5. An ink-jet printhead as claimed in claim 2, wherein the heat transfer layer is formed of a material selected from the group consisting of diamond and SiC.

6. An ink-jet printhead as claimed in claim 2, wherein the first heater is disposed on and above the intermediate layer, and the heat transfer layer for transferring the heat generated by the first heater to the second heater is disposed between the first heater and the second heater.

7. An ink-jet printhead as claimed in claim 6, wherein the first heater, the heat transfer layer, and the second heater excluding a portion in contact with the ink filling the ink chamber are surrounded by an adiabatic layer.

8. An ink-jet printhead as claimed in claim 7, wherein the adiabatic layer is formed of a silicon oxide layer.

9. An ink-jet printhead as claimed in claim 6, wherein the second heater has a cylindrical shape, and the interior of the second heater forms the wall of the ink chamber.

10. An inkjet printhead as claimed in claim 9, wherein the heat transfer layer extends to the outer sides of the second heater.

11. An ink-jet printhead as claimed in claim 2, wherein the first heater is formed on and below the intermediate layer, and the heat transfer layer for transferring the heat from the first heater to the second heater is disposed between the first and second heaters.

12. An ink-jet printhead as claimed in claim 11, wherein the first heater, the heat transfer layer, and the second heater excluding a portion in contact with the ink filling the ink chamber are surrounded by an adiabatic layer.

13. An ink-jet printhead as claimed in claim 12, wherein the adiabatic layer is formed of a silicon oxide layer.

14. An ink-jet printhead as claimed in claim 11, wherein the nozzle plate is formed of silicon, and the substrate is formed of one of photoresist or polyimide.

15. An ink-jet printhead as claimed in claim 1, wherein the second heater is formed of a material selected from the group consisting of diamond, gold, copper, and silicon.

16. An ink-jet printhead as claimed in claim 15, wherein the heat transfer layer is formed of a material selected from the group consisting of diamond and SiC.

17. An ink-jet printhead as claimed in claim 1, wherein the heat transfer layer is formed of a material selected from the group consisting of diamond and SiC.

18. An ink-jet printhead as claimed in claim 1, wherein the first heater is disposed on and above the intermediate layer, and the heat transfer layer for transferring the heat generated by the first heater to the second heater is disposed between the first heater and the second heater.

19. An ink-jet printhead as claimed in claim 18, wherein the first heater, the heat transfer layer, and the second heater excluding a portion in contact with the ink filling the ink chamber are surrounded by an adiabatic layer.

20. An ink-jet printhead as claimed in claim 19, wherein the adiabatic layer is formed of a silicon oxide layer.

21. An ink-jet printhead as claimed in claim 18, wherein the second heater has a cylindrical shape, and the interior of the second heater forms the wall of the ink chamber.

22. An ink-jet printhead as claimed in claim 21, wherein the heat transfer layer extends to the outer sides of the second heater.

23. An ink-jet printhead as claimed in claim 1, wherein the first heater is formed on and below the intermediate layer, and the heat transfer layer for transferring the heat from the first heater to the second heater is disposed between the first and second heaters.

24. An ink-jet printhead as claimed in claim 23, wherein the first heater, the heat transfer layer, and the second heater excluding a portion in contact with the ink filling the ink chamber are surrounded by an adiabatic layer.

25. An ink-jet printhead as claimed in claim 24, wherein the adiabatic layer is formed of a silicon oxide layer.

26. An ink-jet printhead as claimed in claim 23, wherein the nozzle plate is formed of silicon, and the substrate is formed of one of photoresist or polyimide.

27. An ink-jet printhead comprising:

a nozzle plate having a nozzle for ejecting ink;

a substrate having an ink feed hole for supplying ink from an ink reservoir, the substrate being separated from the nozzle plate by a predetermined distance; and an intermediate layer interposed between the substrate and the nozzle plate, the intermediate layer including an ink chamber connected to the ink feed hole and the nozzle and a heating element surrounding the ink chamber, wherein the heating element includes a first heater for generating heat by the application of current and a second heater for receiving the heat generated by the first heater and for boiling ink within the ink chamber to generate a bubble.

28. An ink-jet printhead as claimed in claim 27, wherein the nozzle, the ink chamber, and the ink feed hole are formed in a straight channel.

29. An ink-jet printhead as claimed in claim 28, wherein the second heater is formed of a material selected from the group consisting of diamond and SiC.

30. An ink-jet printhead as claimed in claim 28, wherein the second heater comprises a cylindrical body portion and a flange portion formed on the cylindrical body portion for contacting the first heater.

31. An ink-jet printhead as claimed in claim 30, wherein the first and second heaters excluding a portion in contact with the ink filling the ink chamber are surrounded by an adiabatic layer.

32. An ink-jet printhead as claimed in claim 31, wherein the adiabatic layer is formed of a silicon oxide layer.

33. An ink-jet printhead as claimed in claim 27, wherein the second heater is formed of a material selected from the group consisting of diamond and SiC.

34. An ink-jet printhead as claimed in claim 27, wherein the second heater comprises a cylindrical body portion and a flange portion formed on the cylindrical body portion for contacting the first heater.

35. An ink-jet printhead as claimed in claim 34, wherein the first and second heaters excluding a portion in contact with the ink filling the ink chamber are surrounded by an adiabatic layer.

36. An ink-jet printhead as claimed in claim 35, wherein the adiabatic layer is formed of a silicon oxide layer.

* * * * *